US005235915A

United States Patent [19]

Stevens

[11] Patent Number: 5,235,915

[45] Date of Patent: Aug. 17, 1993

[54] SHOTGUN SLUG TRACER ROUND AND IMPROVED SHOTGUN SLUG

[76] Inventor: Robert D. Stevens, 600 Kiwanis Ct., No. 2, Freeport, Ill. 61032

[21] Appl. No.: 889,065

[22] Filed: May 26, 1992

[51] Int. Cl.[5] ..... F42B 5/02; F42B 7/10; F42B 12/38

[52] U.S. Cl. ..... 102/439; 102/458; 102/513

[58] Field of Search ..... 102/458, 439, 513, 448

[56] References Cited

U.S. PATENT DOCUMENTS

| | | | |
|---|---|---|---|
| 192,829 | 7/1877 | Hotchkiss | 102/514 |
| 306,739 | 10/1884 | Geiger | 102/514 |
| 581,946 | 5/1897 | Semple | 102/513 |
| 1,301,382 | 4/1919 | Buckingham | 102/513 |
| 1,457,337 | 6/1923 | Barrows | 102/458 |
| 1,756,255 | 4/1930 | Meek | 149/37 |
| 1,951,794 | 3/1934 | Jackson et al. | 102/458 |
| 2,368,029 | 1/1945 | Knight | 102/458 |
| 2,700,603 | 1/1955 | Hart et al. | 149/117 |
| 2,976,136 | 3/1961 | Heiskell | 149/37 |
| 3,058,420 | 10/1962 | Tanner et al. | 102/439 |
| 3,262,390 | 7/1966 | Cowles et al. | 102/458 |
| 3,405,638 | 10/1968 | Stoner, Jr. | 102/458 |
| 3,677,842 | 7/1972 | Doris et al. | 149/109 |
| 3,788,907 | 1/1974 | Lehikoinen | 149/37 |
| 3,886,009 | 5/1975 | Puchalski | 149/43 |
| 3,930,844 | 1/1976 | Parrish et al. | 149/109.6 |
| 3,982,930 | 9/1976 | Doades et al. | 149/124 |
| 4,043,267 | 8/1977 | Hayashi | 102/439 |
| 4,063,511 | 12/1977 | Bullard | 102/439 |
| 4,130,061 | 12/1978 | Boggs et al. | 149/19.91 |
| 4,142,466 | 3/1979 | Ballreich et al. | 102/513 |
| 4,301,732 | 11/1981 | Van Sickle | 102/513 |
| 4,387,492 | 6/1983 | Inman | 102/501 |
| 4,389,939 | 6/1983 | Ofuji | 102/513 |
| 4,428,294 | 1/1984 | Falkowski et al. | 102/439 |
| 4,528,911 | 7/1985 | DePhillipo et al. | 102/513 |
| 4,553,481 | 11/1985 | Ricci | 102/458 |
| 4,597,810 | 7/1986 | Trickel et al. | 102/513 |
| 4,776,279 | 10/1988 | Pejsa | 102/514 |
| 4,841,866 | 6/1989 | Miesner | 102/458 |
| 4,879,953 | 11/1989 | Carter | 102/514 |
| 4,958,570 | 9/1990 | Harris | 102/439 |

OTHER PUBLICATIONS

American Rifleman, Nov. 1991, *Shotgun Slugs*, pp. 46–51 & 92.

Guns Illustrated 1989 21st Edition, pp. 17–22.

*Shooting*, by Bob Brister and Dave E. Petzal, "Oct. Slugfest".

*Primary Examiner*—David H. Brown

*Attorney, Agent, or Firm*—Lathrop & Clark

[57] ABSTRACT

A plastic cartridge has a base with a primer pocket and a primer mounted therein. A propellant charge is located within the cartridge and a plastic, collapsible wad is positioned within the cartridge above the propellant charge. A strawlike fusing channel extends through the wad into the propellant charge and is packed with an igniter charge. The fusing channel communicates between the propellant charge and a tracer charge packed within a cavity in a lead shotgun slug. The wad has a plurality of upwardly extending petals which surround the slug within the cartridge and which engage with the rifling of a shotgun barrel when the round is fired.

12 Claims, 3 Drawing Sheets

SHOTGUN SLUG TRACER ROUND AND IMPROVED SHOTGUN SLUG

FIELD OF THE INVENTION

This invention relates to tracer rounds in general and shotgun tracer rounds in particular.

BACKGROUND OF THE INVENTION

The placement of a luminous pyrotechnic charge on the rear of a bullet has long been used to make the flight path of a bullet visible. Because the human eye retains a visual image for approximately 1/15 of a second, a bright luminous pyrotechnic charge traveling along with a high-speed projectile appears to the observer as a luminous line which follows the flight path of the projectile.

Tracer rounds have many uses. A prominent one involves aiming a weapon by observing the flight path of the tracer round by means of its luminous trail and adjusting the gun or weapon until the trails converge with the target. In this way, it is possible to allow for relative movement between the gun and the target and such environmental factors as winds and gravity drop of the bullet. Typically tracer rounds are so employed in anti-aircraft guns which are manually aimed. Tracer rounds are likewise employed with small arms where their use may aid in teaching a marksman to accurately point the gun without aiming. For example, a number of tracer-like products have been developed for shotgun shells for use with shot rounds. Shotgun shot is normally fired at moving targets, either clay pigeons or birds on the wing. The result is insufficient time to employ conventional aiming techniques and the gun must simply be pointed and fired. The incorporation of a luminous source with the shot allows the shooter to judge the results of his efforts and so improve. Tracer rounds for rifles and pistols are often used to indicate when the magazine is empty by using a tracer round for the last round in the magazine. Tracer rounds are also used tactically: for instance, to direct fields of fire and designate targets in small arms military engagements. Tracer rounds are also used at night where conventional aiming techniques may not be possible.

Police forces may use tracers to discriminate between friendly and hostile fire. Ballistically, tracer rounds, by filling the wake of a bullet, may reduce the bullet's drag and improve its accuracy.

Game laws in many states restrict certain hunting seasons to the use of shotgun shot rounds or slugs. The result of these laws has been wide-spread interest in improving the accuracy of shotgun slugs to more nearly approach those of a conventional rifle bullet. However, hithertofor the advantages of a tracer round have not been available in shotgun slugs.

What is needed is a tracer slug adapted for use in a shotgun.

SUMMARY OF THE INVENTION

The shotgun round of the present invention employs a slug with a central axially-aligned cavity in its base. The tracer charge is contained within the base central cavity. The tracer charge consists of a base charge, which is loaded first, which is comprised of 70 percent strontium peroxide by weight, 25 percent magnesium by weight, and 5 percent calcium resinate by weight. Underlying the base charge and filling the axial cavity approximately level with the base of the slug is an igniter charge comprised of 70 percent strontium peroxide by weight, 25 percent magnesium by weight, and 5 percent strontium nitrate by weight.

The slug is loaded in a conventional shotgun shell cartridge. The cartridge surrounds the slug and retains it with a conventional crimp. Beneath the slug is a wad which is preferably constructed of plastic and which has a narrow centrally aligned passageway of fusing channel which communicates with the igniter charge in the base of the slug. The wad has four petals which extend upwardly and surround the slug. Between the wad and the base of the shotgun cartridge is the shotgun shell propellent, also in communication with the passageway through the wad. The wad passageway may be formed by a paper straw and is filled with a fusing compound comprised of 70 percent barium peroxide by weight, 25 percent magnesium by weight, and 5 percent strontium nitrate by weight. The base of the shotgun cartridge contains a primer which is activated by the firing pin of a shotgun. The primer ignites the propellent which deflagrates to form a high-pressure, high-temperature gas for propelling the wad and slug down the barrel of a shotgun. The deflagration (high speed burning) of the propellent continues through the wad by means of the fusing compound which communicates the deflagration, or ignition process, through the wad to the igniter charge which in turn ignites the base charge. The base charge then burns with a bright flame providing the tracer function.

It is an object of the present invention to provide a shotgun slug which functions as a tracer round.

It is another object of the present invention to provide a tracer charge formulated for use with a shotgun slug.

It is a further object of the present invention to provide a wad which incorporates features for the passage of a source of ignition through the wad.

It is also an object of the present invention to provide a shotgun slug tracer formula which may be readily loaded by hand.

It is yet a further object of the present invention to provide a shotgun slug having lower aerodynamic drag and therefore higher velocity.

It is also a further object of the present invention to provide a shotgun round of improved accuracy.

It is yet another object of the present invention to provide a shotgun slug which expands upon impact.

Further objects, features, and advantages of the invention will be apparent from the following detailed description taken in conjunction with the accompanying drawings.

DESCRIPTION OF THE PREFERRED EMBODIMENT

Figure 1:
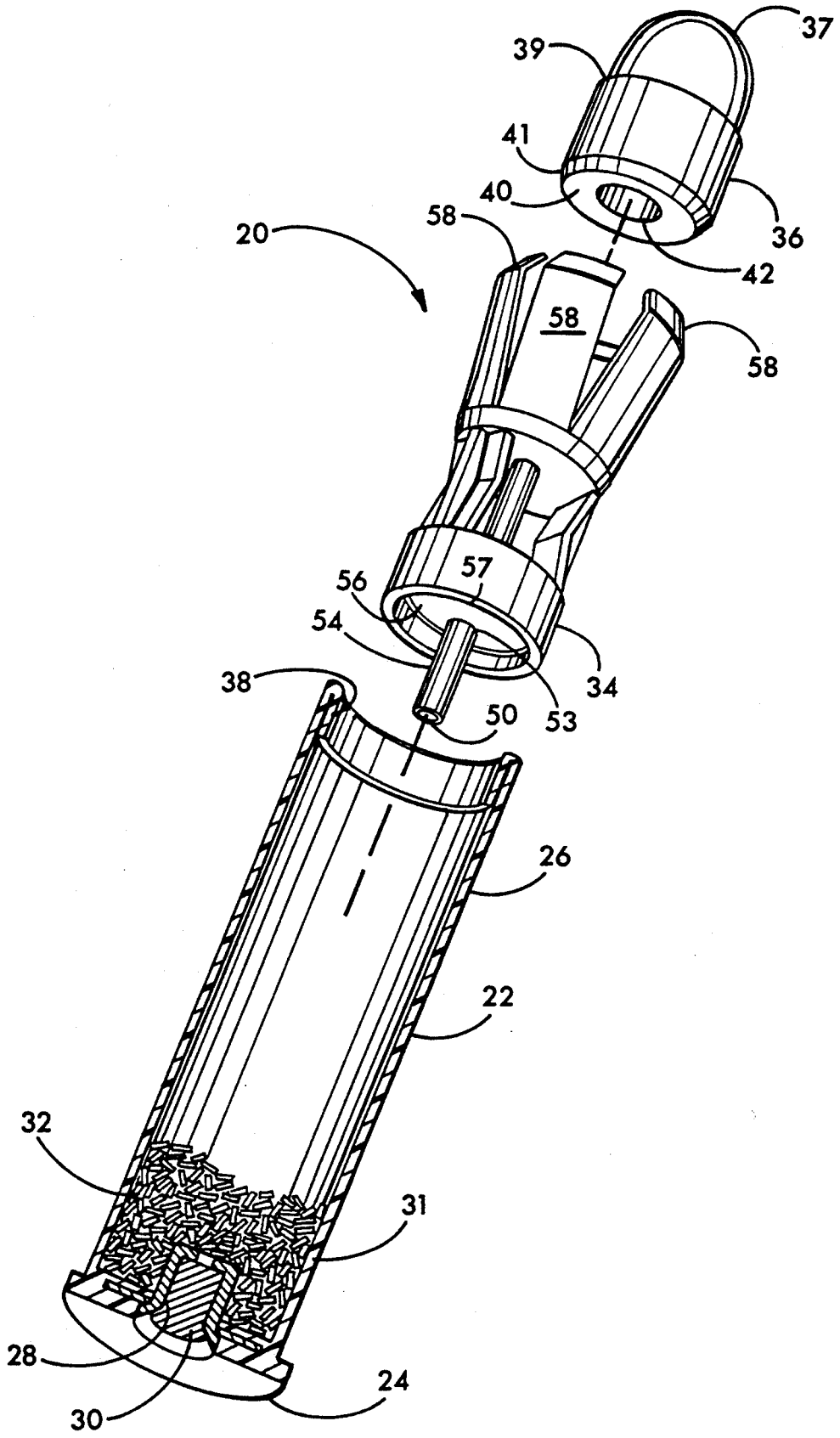
FIG. 1 is a partly cut-away exploded isometric view of the shotgun shell of this invention.

Referring more particularly to FIGS. 1-7 wherein like numbers refer to similar parts, a shotgun tracer round 20 is shown in FIG. 1. The round 20 has a conventional shotgun case or cartridge 22 which normally has a lower base 24 which may alternatively be constructed of metal and a flexible cartridge wall 26 constructed of plastic or treated paper.

Figure 2:
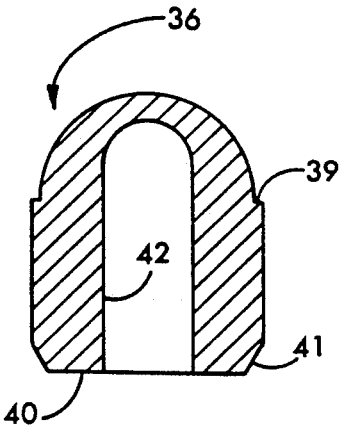
FIG. 2 is a cross sectional view of the shotgun slug of FIG. 1, unloaded with the tracer charge.

In the base 24 of the cartridge is a primer pocket 28 with a primer 30 located therein. The section 31 of the cartridge 22 directly above the primer 30 is filled with a powdered propellent 32 which is overlain by a wad 34. On top of the wad 34 is a shotgun slug 36 which is held in place by a cartridge crimp 38. The slug 36, best shown in FIG. 2, is manufactured of cast or swaged lead. In a 12-gauge configuration, the slug weighs 1½ to 2 oz. as opposed to conventional slugs which generally weigh between 1 and 1¼ oz. The greater weight of the slug 36 results in increased penetration potential due to its higher weight and higher ballistic cross section (weight per unit frontal area). The base 40 of the slug 36 has a central cavity 42 in which the tracer charge 44 is placed. The tracer charge 44 is composed of two components, a base charge 46 and an igniter charge 48. The base charge contains 70 percent strontium peroxide by weight, 25 percent magnesium metal by weight and 5 percent calcium resinate by weight. The central cavity 42 for a 12-gauge slug is approximately ¼ inch in diameter and is positioned over a fusing channel 50 in the wad 34. The fusing channel is filled with a fusing compound 52.

When the tracer round 20 is fired in a shotgun, the firing pin of the shotgun impacts the primer 30 which ignites the propellent 32. The propellent 32 begins a rapid burning or deflagration and ignites the fusing compound 52 in the fusing channel 50 which functions as a high-speed fuse which assures positive ignition of the igniter charge 48 which in turn ignites the base charge 46. The ignited base charge 46 performs the tracer function by burning with a bright luminous flame. This flame permits the trajectory of the slug 36 to be seen. The propellent 32 as it burns creates high-pressure, high-temperature gas which expands against the wad 34 and drives it toward the base 40 of the slug 36. The wad 34 performs the conventional function of a wad in a shotgun shell of compressing and thereby providing more volume for the gases produced by the propellent 32 and so serving to limit peak chamber pressure in the gun. The wad also performs the function of gently accelerating the projectile slug 36. As a wad is essential in shotgun applications, the shotgun tracer round 20 differs from a conventional rifle or pistol tracer round in that the tracer charge 44 is not immediately adjacent to the propellent 32 which normally serves as the source of ignition for the tracer charge 44. The shotgun tracer round 20 must rely on an ignition source which travels through the wad 34 for ignition of the tracer charge. Leaving the fusing channel 50 empty can result in inconsistent ignition of the tracer charge 44. The fusing channel 50 is thus preferably filled with a fusing compound 52. The fusing compound is adapted to rapidly transmit the deflagration front or flame front together with high temperatures and relatively little gas generation. An exemplary fusing compound is comprised of 70 percent strontium peroxide by weight, 25 percent magnesium metal of 325 mesh, and 5 percent strontium nitrate.

The strontium peroxide provides the oxygen for the combustion of the fusing compound. The magnesium provides the fuel with a high flame temperature. The strontium nitrate, a higher temperature oxidizer, helps promote the reaction and increase the speed of burning. A limited amount of calcium resinate may be added to act as a binder. The proportions of the fusing compound components may vary by ±5 percent and still be effective.

The slug cavity 42 is relatively large and is advantageously filled with a large volume of base charge which produces a high brightness, long burning, tracer charge 44. The base charge consists of 70 percent strontium peroxide, 25 percent magnesium of 325 mesh, and 5 percent calcium resinate, and fills approximately 80 percent of the cavity 42. A suitable igniter charge 48 for use with the base charge 46 is comprised of 70 percent strontium peroxide by weight, 25 percent magnesium metal by weight, and 5 percent strontium nitrate. The composition fractions of the igniter compound may vary by ±5 percent.

In an alternative embodiment the presence of the fusing compound 52 in the fusing channel 50 can provide a source of direct ignition to the base 40 of the slug 36 and can ignite a unitary tracer charge 44, thereby eliminating the necessity of an igniter charge 48.

The wad 34 is similar to a "PC 12 gauge Win. length 1⅛ oz. wad" manufactured by GTM Plastics, Inc., 114 N. Third Street, Garland, Tex. The wad 34 may be manufactured from such a wad by drilling a ⅜ inch hole 53 along the axis of the wad 34 to form the fusing channel 50.

A paper straw 54 which has been packed with fusing compound 52 is inserted into the hole 53. The straw 54 forms a fusing channel in the wad 34 which reaches to within ⅛ inch of the primer 30. The straw will preferably extend approximately 7/16 inch below the lower surface 56 of the wad 34. In this way the fuse formed by the fusing channel 50 contained in the paper straw 54 is relatively closely spaced above the primer 30 assuring positive and early ignition of the fusing compound.

The wad 34 has a lower lip 57 which is sealed by the gas pressure generated by the propellent 32 to the cartridge wall 26. The structure of the wad 34 is sufficiently nonrigid that when the round is fired the wad will collapse to a certain extent. This collapse is believed to promote ignition of the tracer compound. Additionally the wad has four petals 58 which extend upwardly. The petals 58 in a conventional wad normally form a container for holding shot as it travels down the barrel of a shotgun. The tracer round 20, however, employs a slug 36 of reduced diameter (for example 0.69 inches for a 12 gauge slug) that fits snuggly within the petals 58 of the wad 34 so that the petals 58 are clamped between the barrel of a shotgun and the slug 36 as it travels down the the shotgun barrel.

The slug 36 and wad 34 combination are particularly advantageously used in a shotgun with a rifled barrel or rifled choke. In a rifled shotgun or in a shotgun employing a rifled choke, problems arise which interfere with the accuracy which the use of rifling is intended to obtain. For example, the slug is deformed upon entering the rifled section of the barrel or choke and this deformation destroys the aerodynamic symmetry of the projectile and thus interferes with accuracy. Another problem is that the barrels of various shotguns vary in diameter depending on the manufacturer. Hence, a slug suitable to be safely fired in all shotgun barrels will fail to grip the rifling sufficient engagement in some larger diameter barrels and thus fail to achieve maximum accuracy. By employing the wad 36 and more particularly the petals 58 as a minimal sabot, the problems of slug deformation and varying shotgun barrel diameters are overcome. The plastic petals 58 of the wad 34 serve to grip the rifling and are also somewhat compliant allowing a single round 20 to be designed to fit all shotgun barrels.

The slug 36 shown in FIG. 2 has an improved shape for functioning with the minimal sabot formed by the petals 58. The frontal portion 37 of the slug 36 is hemispherical with a base diameter which is smaller than the diameter of the slug 36 having a ledge 39 into which the petals 58 are compressed when the slug is loaded into the round 20. To provide a snug fit without undesired bulging, the slug has a chamfer 41 its base, where the petals extend from the wad. Experiments suggest that the central cavity 42 serves not only to contain a tracer compound, but also improves the ability of the slug to expand when it impacts a suitable target. Generally, a cavity diameter of 36 percent of the slug diameter is preferred. A 12 gauge slug of base diameter of 0.69 inches and a central cavity of 0.25 inches in diameter and having a depth extending almost the length of the slug was fired into a sodded pasture back stop and was observed to expand to over one inch in diameter. Weight retention of the recovered slug was approximately 94.6 percent.

An exemplary 12 gauge shotgun tracer round 20 will employ a Federal 209 primer, a propellent consisting of 45 grains of Hercules Blue Dot, a modified P.C. 12 gauge Win. length 1⅛ oz. wad, a slug 36 and a 2¾-inch ACTIV Hull cartridge into which the components of the round are loaded. The tracer portion of the bullet is formed by mixing a relatively votatile anhydrous solvent with the base charge ingredients to provide a slightly damp homogeneous mixture. The preferable solvents are anhydrous methanol or isopropyl alcohol. The slightly damp mixture is suitable for hand loading in that it requires only light pressure by a glass rod or nonsparking metallic plunger. The central cavity 42 is filled with approximately 80 percent base charge material and covered with a layer of igniter charge which has similarly been mixed with anhydrous solvent, preferably methanol or isopropyl alcohol. The igniter compound is gently tamped into the cavity 42 approximately level with the base 40 of the slug 36.

The paper straw 54 may be conveniently formed by wrapping index card material around a ⅛ inch spindle three or four times to form a straw 1¼ inches long with a wall thickness of 1/32 inches and overall diameter of 3/16 inches. The straw is then gently packed with the fusing compound which has been dampened with an appropriate anhydrous relatively volatile solvent (such as methanol or isopropyl alcohol). It is desirable to minimize the calcium resinate in the fusing compound which acts as binder but reduces the speed of burning of the fusing compound. If the rounds are to be subject to rough handling, 2 percent or more calcium resinate may be required to protect the integrity of the fuse formed by the fusing compound 52 and the fusing straw 54. On the other hand, if the tracer round 20 will not be subjected to excessive handling, it may be desirable to completely eliminate calcium resinate as a component to ensure better ignition of the tracer charge 44.

Figure 6:
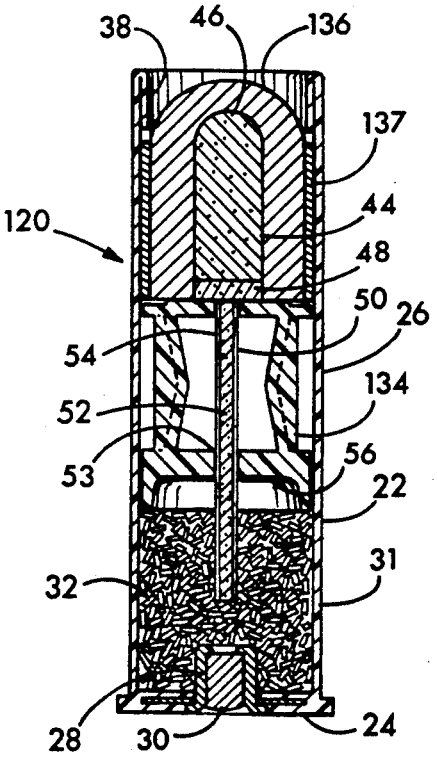
FIG. 6 is a cross-sectional view of an alternative embodiment of the shotgun tracer round of this invention.

An alternative embodiment tracer round 120, shown in FIG. 6, employs a wad 134 without petals and may be conveniently formed by cutting the petals off a typical wad. The round 120 has a slug 136 custom dimensioned to accommodate a particular manufactured barrel diameter.

Figure 3:
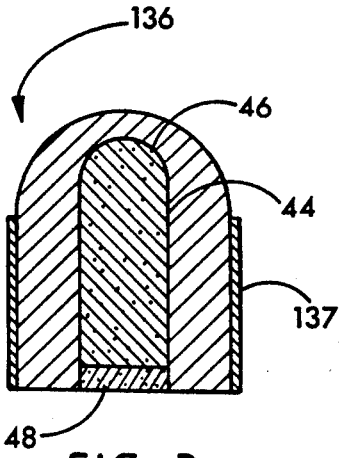
FIG. 3 is a cross-sectional view of an alternative embodiment of a shotgun tracer slug of the present invention having a partial copper jacket.

In the tracer round configuration 120 the slug 136, best shown in FIG. 3, employs a copper jacket 137 for jacket 137 for gripping the lands of the rifling in a rifled shotgun. The slug 136 has a diameter which closely fits a particular shotgun barrel so as to closely engage the riffling of the barrel.

The copper jacket 137 serves to prevent lead from rubbing onto and clogging the rifling. The copper jacket 137 also helps to maintain the integrity in shape of the slug 136.

Figure 4:
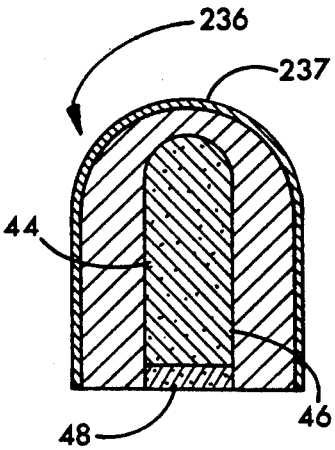
FIG. 4 is a cross-sectional view of another embodiment of the shotgun tracer slug of this invention having a full copper jacket.
Figure 5:
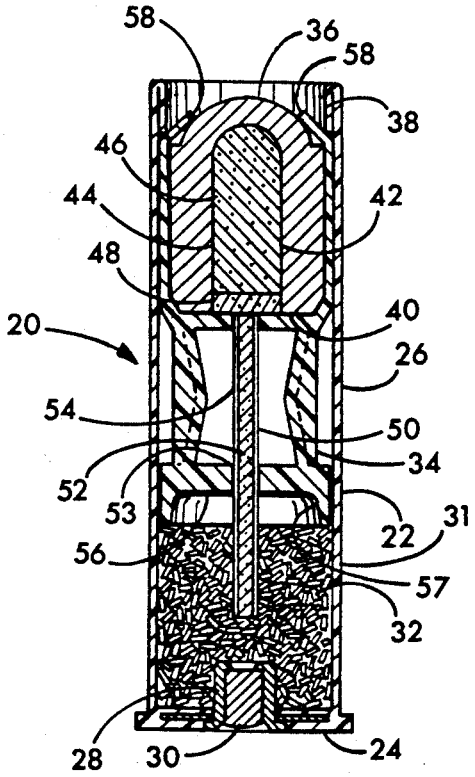
FIG. 5 is a cross-sectional view of the shotgun tracer round of FIG. 1.

An alternative embodiment slug 236, shown in FIG. 4, employs a copper jacket 237 encompassing the entire round. The slugs 136, 236 will have a diameter to closely fit a particular manufacturer's barrel diameter.

The tracer charge 44 has the primary function of providing a luminous source traveling with the slug 36. However, it may have the additional function of decreasing the aerodynamic drag experienced by the slug 36 in flight. A rapidly moving projectile with a blunt downstream side or base creates a region of low pressure on the rear of the projectile. This region of low pressure produces a retarding force on the projectile which can account for a considerable percentage of the total aerodynamic drag produced by high-speed flight. The tracer charge 44 may act as a "fumer" generating gas which fills the region of low pressure at the base of the projectile thereby significantly reducing basal drag. The base filling capability of the tracer charge 44 may be increased by the addition of excess fuel, preferably one that produces a low molecular weight gas. The use of a fumer is particularly advantageous in a shotgun slug which has a proportionally larger base area than most rifled bullets.

Figure 7:
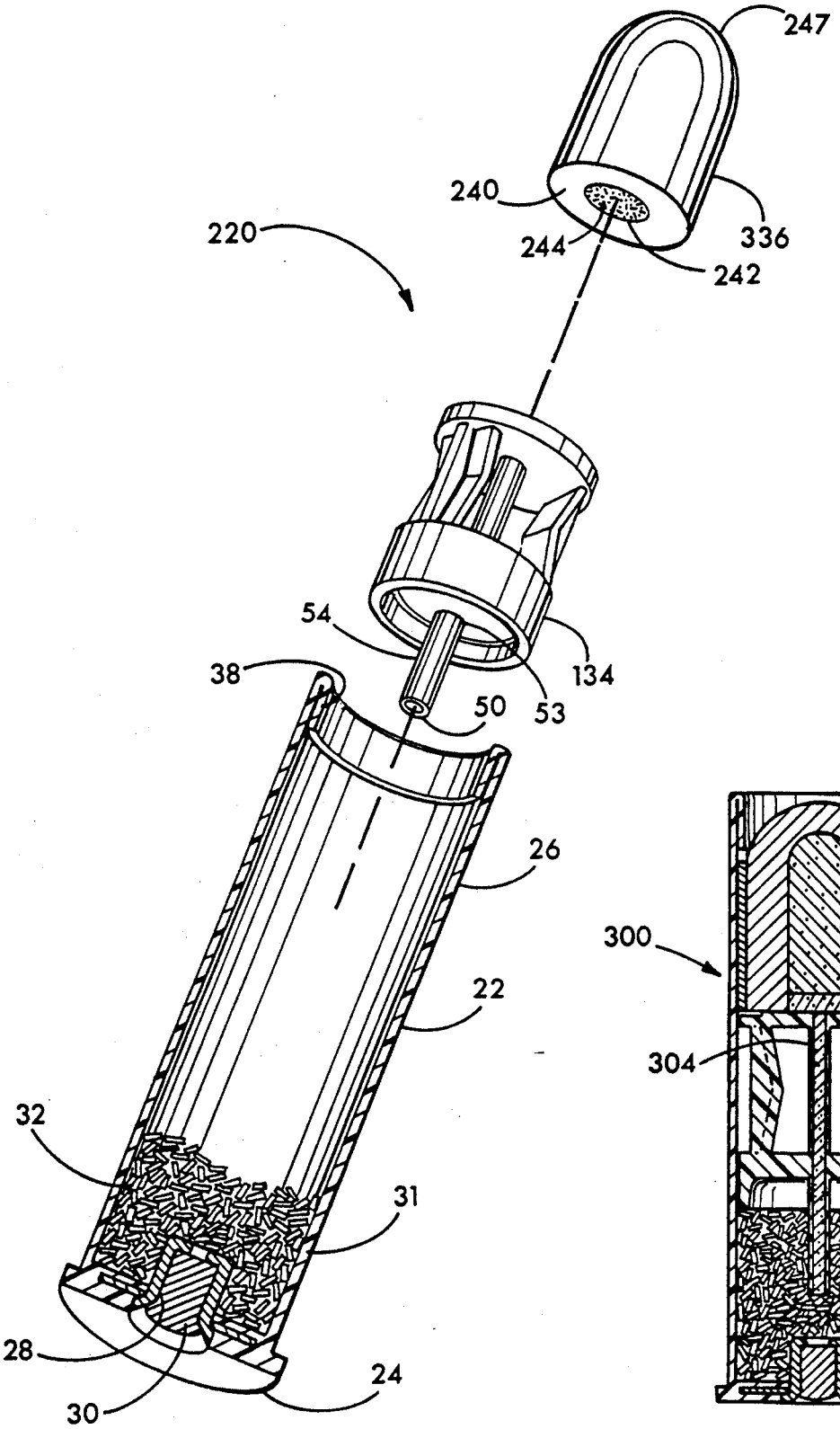
FIG. 7 is an exploded isometric view, partially broken away, of an alternative shotgun tracer round of the present invention.

Another alternative embodiment 220 of a shotgun tracer round is shown in FIG. 7. The round 220 has a plastic wad 134 without petals and a lead slug 336 without jacketing. The slug 336 has a hemispherical frontal portion 247 and a base 240 having a cavity 242 filled with tracer charge 244. This round is advantageously configured for accuracy in use with a specific rifled shotgun barrel. The slug diameter is precisely the diameter of the shotgun rifling measured between groove floors, for example, in a Hastings barrel 0.725 inches.

It should be understood that whereas strontium peroxide is preferred in the fusing compound, barium peroxide may be used.

Figure 8:
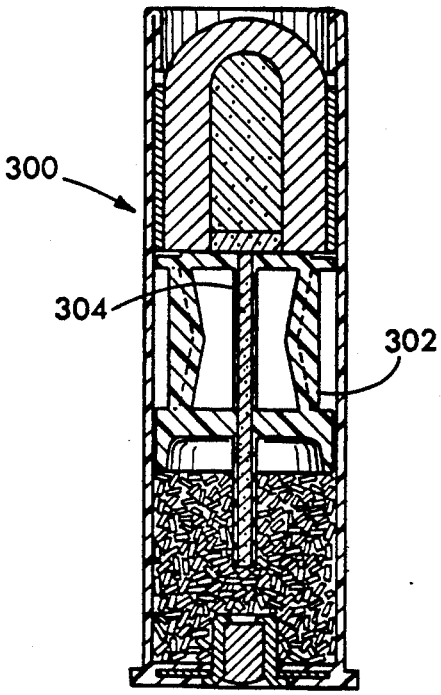
FIG. 8 is a cross-sectional view of another alternative embodiment of the shotgun tracer round of this invention having an integral plastic passageway incorporated in the wad.

It should also be understood that although the fusing channel is described as having a paper straw an integral plastic passageway conforming to the configuration of the straw could be incorporated in the wad. Such an alternative shotgun tracer round 300 is shown in FIG. 8 and has a wad 302 having an integral passageway 304.

It should also be understood that although a plastic wad has been described conventional cardboard wads with a centrally located hole and a fusing straw mounted therein could be used.

It should further be noted that, although the tracer charge of the chemical composition described above will have advantageous properties, many other tracer compounds utilized in rifle rounds and other ballistic applications may be employed with the round of this invention.

The assembly instructions have been given for hand loading tracer rounds 20 however the process could be automated and performed by machinery.

It is understood that the invention is not confined to the particular construction and arrangement of parts therein illustrated and described, but embraces all such modified forms thereof as come within the scope of the following claims.

I claim:

1. A shotgun tracer round for use with a shotgun having a barrel with a first internal diameter, the round comprising:

a) a shotgun slug having a cylindrical portion of a diameter approximately equal to the barrel first internal diameter and so defining a cylindrical axis and approximately cylindrical surface, the surface being adapted to closely engage the barrel of a shotgun, the slug having a base beneath the cylindrical portion, wherein the slug has portions defining a cavity extending upward from the base, the cavity being symmetric about the axis of the cylinder.

b) at least one wad positioned beneath and adjacent to the base of the slug, the wad having portions defining a fusing channel extending from the cavity in the base of the slug;

c) a propellent charge positioned beneath the wad and in communication with the fusing channel;

d) a tracer charge substantially filling the slug cavity and adjacent the fusing channel, wherein the fusing channel is adapted to facilitate the ignition of the tracer charge when the round is fired; and e) a shotgun cartridge surrounding and containing the slug, the wad, and the propellent charge.

2. The shotgun round of claim 1 wherein the slug has a frontal surface opposite the base which has the shape of a portion of a sphere and is adapted to reduce the aerodynamic drag of the slug.

3. The shotgun round of claim 1 wherein the wad is formed of deformable plastic.

4. The shotgun round of claim 1 wherein the fusing channel is a hollow cylindrical tube which extends beneath the wad into the propellent charge contained within the cartridge.

5. The shotgun round of claim 1 further comprising a fusing compound substantially filing the fusing channel, the fusing compound being adapted to transmit the deflagration of the propellent charge to the tracer charge.

6. The shotgun round of claim 5 wherein the fusing compound is comprised of about 70 weight percent barium peroxide, about 25 weight percent magnesium and 5 percent strontium nitrate.

7. The shotgun round of claim 1 wherein the tracer charge comprises a base charge filling the majority of the cavity and an igniter charge beneath the base charge adjacent to the fusing channel.

8. The shotgun round of claim 7 wherein the base charge is comprised of about 70 weight percent strontium peroxide, about 25 weight percent magnesium, and about 5 weight percent calcium resinate; and the igniter charge adjacent to the slug base is comprised of about 70 weight percent strontium peroxide, about 25 weight percent magnesium, and about 5 percent strontium nitrate.

9. A shotgun tracer round comprising:

a) a shotgun slug having a cylindrical portion and so defining a cylindrical axis and approximately cylindrical surface, the surface being adapted to closely engage the barrel of a shotgun, the slug having a base beneath the cylindrical portion, wherein the slug has portions defining a cavity extending upward from the base, the cavity being symmetric about the axis of the cylinder;

b) a copper cylindrical jacket covering the cylindrical sides of the slug which are adapted to closely engage the barrel of a shotgun;

c) at least one wad positioned beneath and adjacent to the base of the slug, the wad having portions defining a fusing channel extending from the cavity in the base of the slug;

d) a propellent charge positioned beneath the wad and in communication with the fusing channel;

e) a tracer charger substantially filling the slug cavity and adjacent the fusing channel, wherein the fusing channel is adapted to facilitate the ignition of the tracer charge when the round is fired; and f) a shotgun cartridge surrounding and containing the slug, the wad, and the propellent charge.

10. A shotgun tracer round comprising:

a) a shotgun slug having a cylindrical portion and so defining a cylindrical axis and approximately cylindrical surface, the surface being adapted to closely engage the barrel of a shotgun, the slug having a base beneath the cylindrical portion, wherein the slug has portions defining a cavity extending upward from the base, the cavity being symmetric about the axis of the cylinder, and wherein the slug has a frontal surface opposite the base which has the shape of a portion of a sphere and is adapted to reduce the aerodynamic drag of the slug, and wherein the slug has a copper jacket surrounding the cylindrical surface and the frontal surface;

b) at least one wad positioned beneath and adjacent to the base of the slug, the wad having portions defining a fusing channel extending from the cavity in the base of the slug;

c) a propellent charge positioned beneath the wad and in communication with the fusing channel;

d) a tracer charge substantially filling the slug cavity and adjacent the fusing channel, wherein the fusing channel is adapted to facilitate the ignition of the tracer charge when the round is fired; and e) a shotgun cartridge surrounding and containing the slug, the wad, and the propellent charge.

11. A shotgun tracer round for use in a shotgun barrel comprising:

a) a cartridge having a base and a primer mounted therein;

b) a propellent charge contained within the cartridge and engaged with the base adjacent to the primer;

c) a collapsible wad assembly having a wad and a fusing channel which extends through the wad and beneath the wad into proximity to the primer; and d) a shotgun slug positioned within the cartridge adjacent the wad, the slug having portions defining a cavity, wherein a tracer charge is located within the cavity and positioned to be ignited through the fusing channel.

12. The shotgun round of claim 11 wherein the fusing channel is packed with a fusing compound which sustains and transmits a source of ignition to the tracer charge.

* * * * *